US008963790B2

(12) United States Patent
Brown

(10) Patent No.: US 8,963,790 B2
(45) Date of Patent: Feb. 24, 2015

(54) UNIVERSAL MICROWAVE WAVEGUIDE JOINT AND MECHANICALLY STEERABLE MICROWAVE TRANSMITTER

(75) Inventor: Kenneth W. Brown, Yucaipa, CA (US)

(73) Assignee: Raytheon Company, Waltham, MA (US)

( * ) Notice: Subject to any disclaimer, the term of this patent is extended or adjusted under 35 U.S.C. 154(b) by 244 days.

(21) Appl. No.: 13/586,592

(22) Filed: Aug. 15, 2012

(65) Prior Publication Data

US 2014/0049435 A1 Feb. 20, 2014

(51) Int. Cl.
*H01Q 13/00* (2006.01)

(52) U.S. Cl.
USPC ..... 343/772; 343/762; 333/256

(58) Field of Classification Search
CPC ..... H01Q 13/00; H01Q 3/01; H01Q 3/02; H01P 1/06
USPC ..... 343/772, 256, 757, 762, 763, 765, 766; 333/21 R, 249, 254, 239, 256, 257
See application file for complete search history.

(56) References Cited

U.S. PATENT DOCUMENTS

| | | | | | |
|---|---|---|---|---|---|
| 2,420,007 | A * | 5/1947 | Olden | 343/786 |
| 2,956,248 | A * | 10/1960 | Strand | 333/241 |
| 3,349,346 | A * | 10/1967 | Enderby | 333/21 R |
| 4,119,971 | A | 10/1978 | Stark | |
| 4,369,413 | A * | 1/1983 | Devan et al. | 333/34 |
| 4,616,191 | A | 10/1986 | Galani et al. | |
| 4,916,458 | A | 4/1990 | Goto | |
| 6,061,033 | A | 5/2000 | Hulderman et al. | |
| 6,462,718 | B1 * | 10/2002 | Ehrenberg et al. | 343/880 |
| 7,378,914 | B2 | 5/2008 | Gallivan et al. | |
| 7,973,613 | B2 | 7/2011 | Chang et al. | |
| 8,182,103 | B1 * | 5/2012 | Brown et al. | 359/849 |
| 2006/0184456 | A1 * | 8/2006 | de Janasz | 705/72 |
| 2008/0278395 | A1 * | 11/2008 | Blalock | 343/757 |
| 2010/0185321 | A1 * | 7/2010 | Odashima | 700/230 |

* cited by examiner

*Primary Examiner* — Dameon E Levi
*Assistant Examiner* — Collin Dawkins
(74) *Attorney, Agent, or Firm* — Eric A. Gifford

(57) ABSTRACT

A universal joint comprising a pair of circular waveguide ball-joints and a slip-joint allows for simultaneous 3-axis rotation and 3-dimensional translation between an antenna and a stationary source. As such, the universal joint does not have to be physically aligned with the azimuth, and elevation, rotation axis of the antenna and mounted on the gimbal support, greatly simplifying the antenna steering mechanism. The universal joint allows the antenna to be mass-balanced in relation to the azimuth and elevation axis without adding any additional counter weights, thus reducing the size and power requirements of the azimuth and elevation rotation drive systems. Additional ball-joints may be provided to increase the allowed range of motion of the antenna.

19 Claims, 6 Drawing Sheets

UNIVERSAL MICROWAVE WAVEGUIDE JOINT AND MECHANICALLY STEERABLE MICROWAVE TRANSMITTER

BACKGROUND OF THE INVENTION

1. Field of the Invention

This invention relates to microwave rotating waveguide joints that transmit microwave energy from a stationary source to feed a mechanically steerable microwave transmitter, and more particularly to a universal microwave waveguide joint that allows for simultaneous 3-axis rotation and 3-dimensional translation between the transmitter's antenna and the stationary source.

2. Description of the Related Art

A mechanically steerable microwave transmitter includes a source that generates a beam of microwave radiation, an antenna that projects the beam, through foe space, and a gimbal mechanism, that rotates the antenna about the Azimuth and Elevation axes to point the beam in any direction of a hemisphere and a waveguide to direct the beam from the output of the stationary source to the antenna feed. Exemplary sources may include a magnetron or klystron that produce a high power beam of microwave radiation having a frequency within approximately 100 MHz to approximately 300 GHz, roughly spanning the L-band to the G-band. Exemplary antennas may include a slotted waveguide array, reflector or horn. The antenna, may be either uni-directional in which it only transmits the beam or bi-directional in which it may either transmit or receive microwave radiation.

Two important problems in the design of a gimbaled transmitter are coupling the beam from the source to the antenna and minimizing the beam loss between the source and the antenna. In one straightforward approach, the source is affixed to the antenna and must be supported and moved by fee gimbal mechanism. This approach is not desirable for many transmitter systems due to the weight and bulk of the source, which, in turn requires that the gimbaling mechanism be larger and heavier than desirable.

Responsive to this problem, transmitter systems have been developed wherein the source is stationary, and a waveguide extends from the source to the antenna. As used herein a "waveguide" is hollow conductive pipe. Waveguides are typically rectangular or circular and formed from metal The width of the waveguide is typically on the order of the wavelength of the transmitted microwave beam. For example, a circular waveguide supports different $TE_{mn}$ or $TM_{mn}$ modes of beam propagation where "m" and "n" refer to the number of sinusoidal half cycles the field pattern makes in the circumferential "m" and the radial "a" directions. The $TE_{11}$ mode is known as the "dominant" mode in a circular waveguide and the $TE_{01}$ mode is a "non-dominant" mode. The waveguide has one or more rotary joints to allow the antenna to rotate with respect to the stationary source. Each rotary joint allows for 1-axis of motion, i.e. roll about the axis through the rotary joint. One rotary joint is mounted on the elevation gimbal support and another rotary joint is mounted on the azimuth gimbal support.

An exemplary microwave rotary joint is illustrated in U.S. Pat. No. 7,973,613. The rotary joint includes a pair of circular waveguides one of which is fixed and one of which rotates inside the other. A pair of mode converters is connected to the circular waveguides at the input and output, respectively, of the rotary joint. One of the mode converters converts a rectangular $TE_{10}$ mode from the source to the axial symmetric circular $TE_{01}$ mode that propagates through the rotary joint.

The other mode converter converts the $TE_{01}$ mode back to a rectangular $TE_{10}$ mode to feed the antenna.

Because the rotary joints are mounted on the gimbal mechanism, one each on the elevation gimbal support and the azimuth gimbal support, the center of mass of the antenna is shifted away from the azimuth and elevation axes. Typically heavy and bulky counter weights are added to shift the center of mass back to the azimuth and elevation axes to mass-balance the assembly. This further increases the total mass that must be driven to steer the antenna.

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides a universal microwave waveguide joint ("universal joint") that allows for simultaneous 3-axis rotation, and 3-dimensional translation between the transmitter's antenna, and the stationary source. As such, the universal joint does not have to be physically aligned with the azimuth and elevation rotation axis of the antenna and mounted on the gimbal support, greatly simplifying the antenna steering mechanism. The universal joint allows the antenna to be mass-balanced in relation to the azimuth and elevation axis without adding any additional counter weights, thus reducing the size and power requirements of the azimuth and elevation rotation drive systems.

In an embodiment a mechanically steerable microwave transmitter system comprises a stationary source of a beam of microwave radiation in a first waveguide mode, an antenna for receiving the beam of microwave radiation from a second waveguide mode and then transmitting free-space radiation, and a gimbal support that supports only the antenna. The first and second waveguide modes may, for example, be the dominant rectangular $TE_{10}$ mode. The gimbal support is operable to rotate the antenna about azimuth and elevation, axes through the center of mass of the antenna. A waveguide directs the beam of microwave radiation from the stationary source to the antenna. The waveguide comprises a first microwave waveguide mode converter coupled to the beam source that converts the first waveguide mode of the beam to a circular axial symmetric waveguide mode (suitably the non-dominant circular $TE_{01}$ mode), a second microwave waveguide mode converter coupled to the antenna that converts the circular axial symmetric waveguide mode of the beam, to the second waveguide mode of the antenna input and a universal joint connected between the first and second mode converters along a waveguide axis offset from the antenna's azimuth and elevation axes. The universal joint comprises a circular waveguide slip-joint allowing for 1-dimensional translation along the waveguide axis and first and second circular waveguide ball-joints each allowing for 3-axis rotation around and orthogonal to the waveguide axis. The universal, joint is fixed at the first mode converter while allowing 3-axis rotation and 3-dimensional translation between the antenna and the stationary source at the connection to the second mode converter. Additional ball-joints may be provided to increase the allowed range of motion of the antenna.

These and other features and advantages of the invention will be apparent, to those skilled in the art from, the following detailed description of preferred embodiments, taken together with the accompanying drawings, in which:

DETAILED DESCRIPTION OF THE INVENTION

The present invention provides a universal microwave waveguide joint ("universal joint") that allows for simultaneous 3-axis rotation and 3-dimensional translation between the mechanically steerable transmitter's antenna and the stationary source. As such, the universal joint does not have to be physically aligned with the azimuth and elevation rotation axis of the antenna and mounted on the gimbal support, greatly simplifying the antenna steering mechanism. The universal joint allows the antenna to be mass-balanced in relation to the azimuth and elevation axis without adding any additional counter weights, thus reducing the size and power requirements of the azimuth and elevation rotation drive systems.

Figure 1:
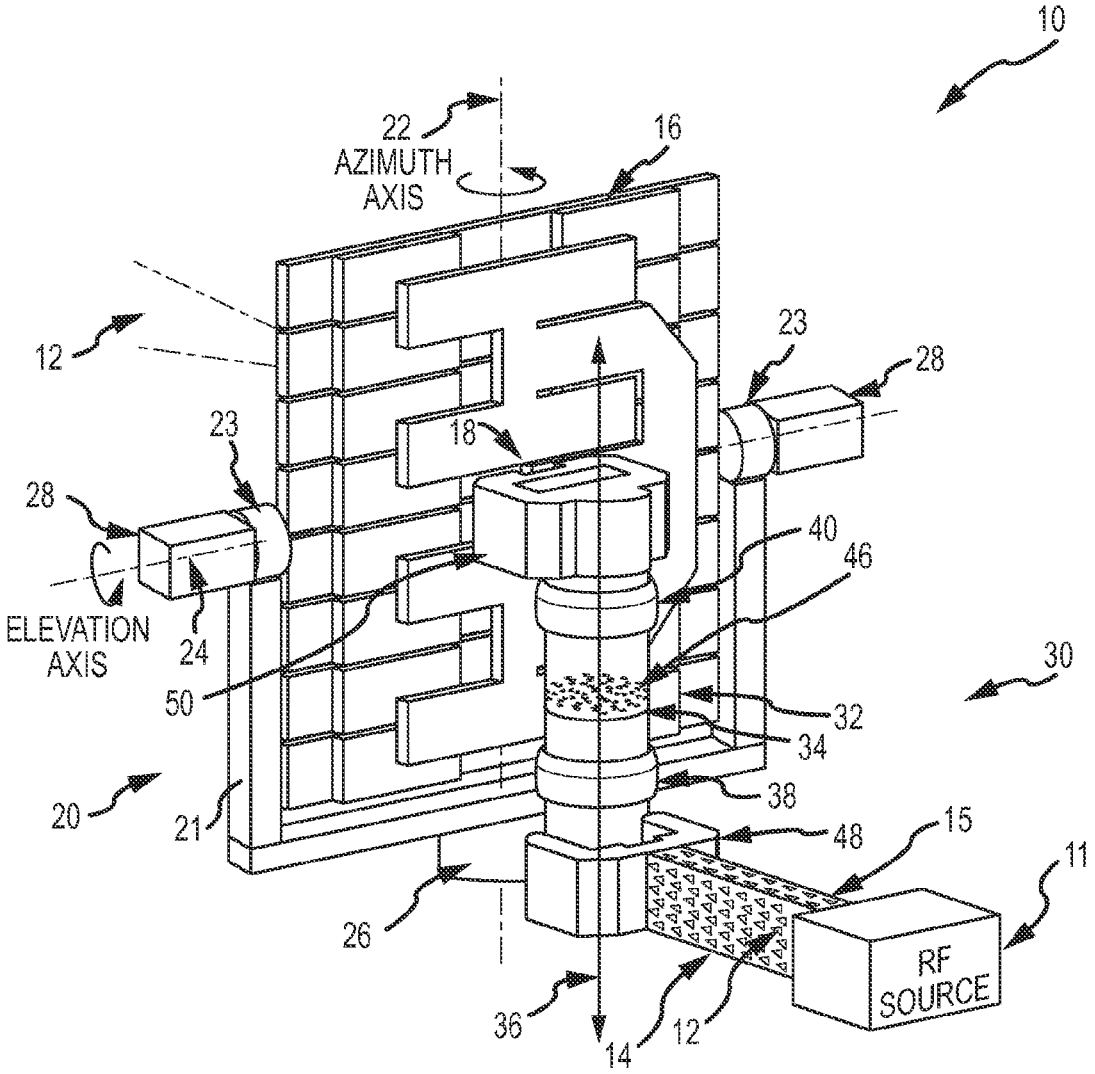
FIG. 1 is a diagram, of an embodiment of a mechanically steerable antenna including a universal joint.
Figure 2:
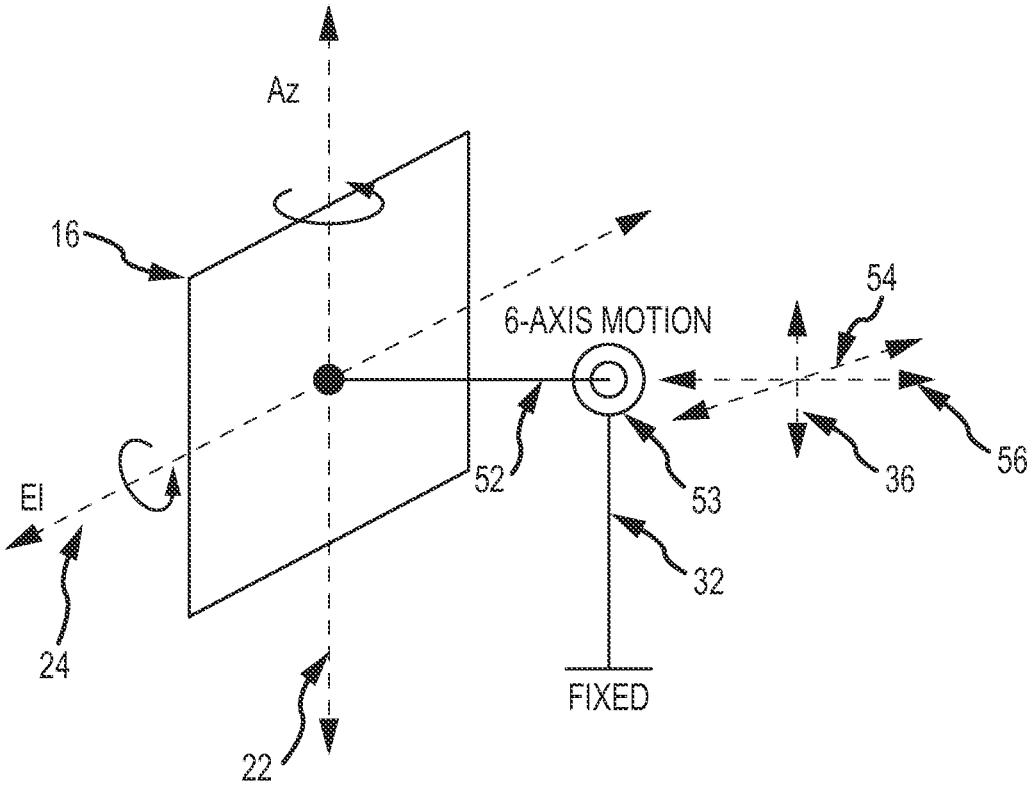
FIG. 2 is a schematic diagram, illustrating the 6-axis motion induced in the universal joint by 2-axis motion of the antenna.

Referring now to FIGS. 1 and 2, an embodiment of a mechanically steerable transmitter 10 includes a stationary source 11 that generates a beam 12 of microwave radiation that propagates in a first waveguide mode 14 e.g. rectangular $TE_{10}$, in a waveguide 15, an antenna 16 (e.g. a slotted waveguide array antenna) that receives the beam 12 of microwave radiation in a second waveguide mode 18 e.g. rectangular $TE_{10}$, and transmits lire beam as free-space radiation, and a gimbal support 20 that supports only the antenna 16. The first and second waveguide modes may, for example, be the rectangular $TE_{10}$ mode. The gimbal support 20 includes a rotational gimbal support 21 and an elevation gimbal support 23 mounted on the rotational gimbal support 21. Azimuth and elevation drive motors 26 and 28, respectively, rotate rotational gimbal support 21 and elevation gimbal support 23 about azimuth and elevation axes 22 and 24, respectively, through, the center of mass of the antenna to mechanically steer antenna 16. Other configurations for gimbal support 20 are operable to steer the antenna in azimuth and elevation. No counter weights are used to mass-balance the antenna.

In different embodiments, stationary source 11 may include a magnetron or klystron that produce a beam of microwave radiation having a frequency within approximately 100 MHz to approximately 300 GHz, roughly spanning the L-band to the G-band. Typical high-power microwave sources are disclosed in U.S. Pat. Nos. 4,616,191; 7,378,914 and 8,182,103.

In different embodiments, antenna 16 may include a slotted waveguide, reflector or horn. The antenna may be either unidirectional in which it only transmits the beam or bi-directional in which it may either transmit or receive microwave radiation. An exemplary reflector antenna is disclosed in U.S. Pat. No. 6,061,033. An exemplary slotted waveguide array antenna is disclosed in U.S. Pat. Nos. 4,119,971 and 4,916,458.

A waveguide 30 directs the beam 12 of microwave radiation from the stationary source 11 to the antenna 16, Waveguide 30 includes a universal joint 32 that allows for 3-axis rotation and 3-dimensional translation between the antenna and the stationary source at the connection to the second mode converter. Universal joint 32 comprises a circular waveguide slip-joint 34 allowing for 1-dimensional translation along a waveguide axis 36 and first and second circular waveguide ball-joints 38 and 40 each allowing for 3-axis rotation around and orthogonal to the waveguide axis (i.e. rotation in two orthogonal axes). In this embodiment, slip-joint 34 separates ball-joints 38 and 40. Alternately, slip-joint 34 could be placed at either end. One or more additional ball-joints may be used to increase the allowed range of motion of the antenna in rotation about either the azimuth or elevation axes.

Universal joint 32 allows for the 6-axis motion between the antenna 16 and the stationary source 11. The first ball joint 38 "points" to the location of the second ball joint 40 providing the first and second axes of motion. The slip joint 34 determines how far away the second ball joint 40 is from the first ball-joint 38 providing the third axis of motion. The second ball joint 40 points the waveguide output in any direction providing the fourth, fifth and sixth axes of motion.

The electric field structure of a circular waveguide TE mode 46 in universal joint 32 is important to minimizing the beam loss between the source and the antenna. Typically the dominant circular $TE_{11}$ mode is used to direct microwave radiation through circular waveguides. This mode is linear polarized and has a high axial RF current content along the length of the waveguide wall. By contrast the electric field of the non-dominant circular $TE_{01}$ mode (more generally the circular $TE_{0N}$ mode where N is 1, 2, 3. . . ) is axially symmetric and has zero axial RF current traveling along the length of the guide.

These properties make the circular $TE_{01}$ or more generally the circular $TE_{0N}$ mode preferable for use with universal joint 32. First, the waveguide RF loss is extremely low since axial $I^2R$ losses in the waveguide wall are zero. Second, the waveguide wall can be substantially perturbed or altered without greatly effecting the circular $TE_{01}$ mode propagation. This allows the waveguide wall to be cut, rotated, lengthened, shortened and even bent without greatly affecting the propagation of the circular $TE_{01}$ mode. Third, since the HPM energy is contained away from the waveguide wail (unlike the dominant circular $TE_{11}$ mode), substantial, power can be propagated through the guide, even in the presence of waveguide wall perturbations. And fourth, since there is no axial RF current (along the length of the guide), cut (and slightly separated) sections of waveguide do not significantly radiate RF.

The waveguide modes used by the stationary source 11 and antenna 16 are typically not the circular $TE_{01}$ mode. Typically sources and antennas use rectangular waveguides, and thus the dominant rectangular $TE_{10}$ mode. Even if the source or antenna used a circular waveguide, it would likely employ the dominant circular $TE_{11}$ mode. Therefore waveguide 30 further includes a first microwave waveguide mode converter 48 coupled to die source 11 that converts the first waveguide mode 14 of the beam to the circular axial symmetric waveguide mode 46 and a second microwave waveguide mode converter 50 coupled to the antenna 16 that converts the circular axial symmetric waveguide mode 46 of the beam to the second waveguide mode 18 at the antenna input. An exemplary mode converter that converts between rectangular $TE_{10}$ and circular $TE_{01}$ modes is fully described in U.S. Pat. No. 7,973,613,which is hereby incorporated by reference. The mode converter is suitably designed to suppress the dominant circular $TE_{11}$ mode.

Universal joint 32 is connected between the first and second mode converters 48 and 50 along waveguide axis 36 offset from the antenna's azimuth and elevation axes. The universal joint is fixed (stationary) at the first mode converter 48 while allowing 3-axis rotation and 3-dimensional translation between the antenna 16 and the stationary source 11 at the connection to the second mode converter 50. The second mode converter 50 is connected to the input feed of antenna 11. The feed can be located at any position on antenna 11; it does not have to be positioned at the intersection of the azimuth and elevation axes. Furthermore, waveguide axis 36 is not required to be parallel to the azimuth axis 22. The mode converters or another section of waveguide may be used to turn the axis from, either the antenna feed or the output of the stationary source. All that is required is that waveguide axis 36 be offset from both of the antenna's azimuth and elevation axes. It is preferred that the ball-joints are at a neutral position i.e. zero rotation, in either orthogonal direction when the antenna is at its neutral position, i.e. zero rotation in either azimuth or elevation in order to allow for a symmetric range of motion of the antenna.

The schematic of FIG. 2 depicts the 2-axis rotation of antenna 16 about its azimuth and elevation axes 22 and 24 and the required 6-axis of motion 53 of universal joint 32 between the antenna 16 and the stationary source. Physically decoupling the universal joint 32 from the gimbal support so that the antenna is mass-balanced without, additional counter weights produces an offset of the universal joint's waveguide axis from the antenna's azimuth and elevation axis. This offset acts as a lever arm 52 that is fixed to antenna 16. 2-axis rotation of antenna 16 acting through lever arm 52 produces 6-axis motion 53 at the non-fixed end of the universal, joint 32; 3-axis rotation and 3-dimensional translation. The 3-axis rotation is around and orthogonal to waveguide axis 36 (i.e. rotation about orthogonal axes 54 and 56). The 3-dimensional translation is along waveguide axis 38 and the two orthogonal axes 54 and 56.

Figure 3B:
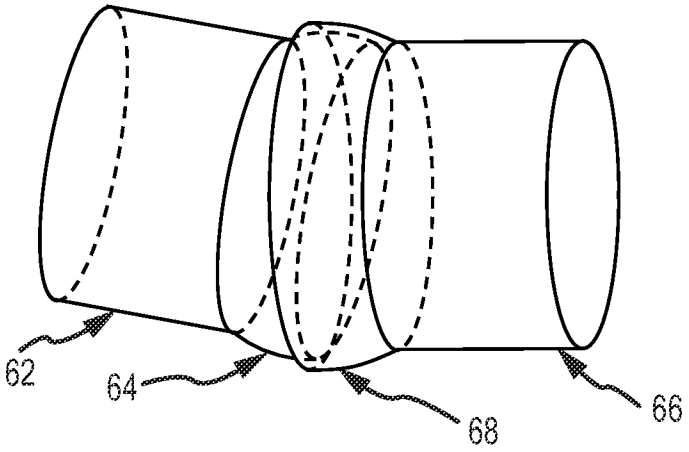
FIGS. 3*a* and 3*b* are diagrams of an embodiment of a circular waveguide ball-joint.
Figure 3A:
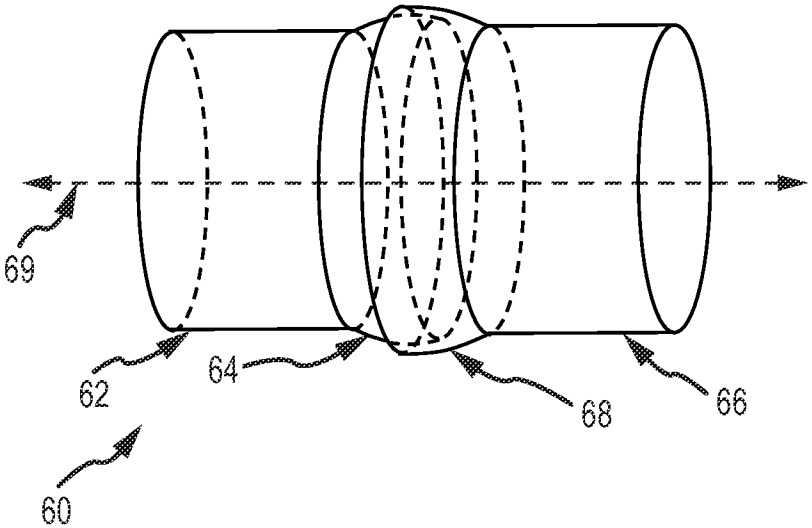

Referring now to figures 3*a* and 3*b*, an embodiment of a circular waveguide ball-joint 60 comprises a first circular waveguide 62 fitted with a first coupler 64 having a spherical cross section and a second circular waveguide 66 fitted with a second coupler 68 having a complementary spherical cross section. The first and second couplers' spherical cross sections are mechanically engaged to provide 3-axis rotation around and orthogonal to the waveguide axis 69.

The waveguide ball-joint allows the circular waveguide 62 to be both rotated (about the waveguide axis) and bent orthogonal to the waveguide axis (about the ball-joint rotational center) in two axes. The circular waveguide 62 can be rotated 360° about the waveguide axis. The circular waveguide 62 can be bent orthogonal to the waveguide axis in two axes. The range of motion with which the waveguide can be bent (i.e. rotated about one of the orthogonal axis) is determined by the geometry of the joints and by how much beam loss can be tolerated. In an embodiment, beam loss can be mitigated by extending the circular waveguides 62 and 66 into their respective couplers 64 and 66 to maintain a circular cross section for the microwave beam in the axial symmetric TE mode without interfering with the defined range of motion.

Figure 4:
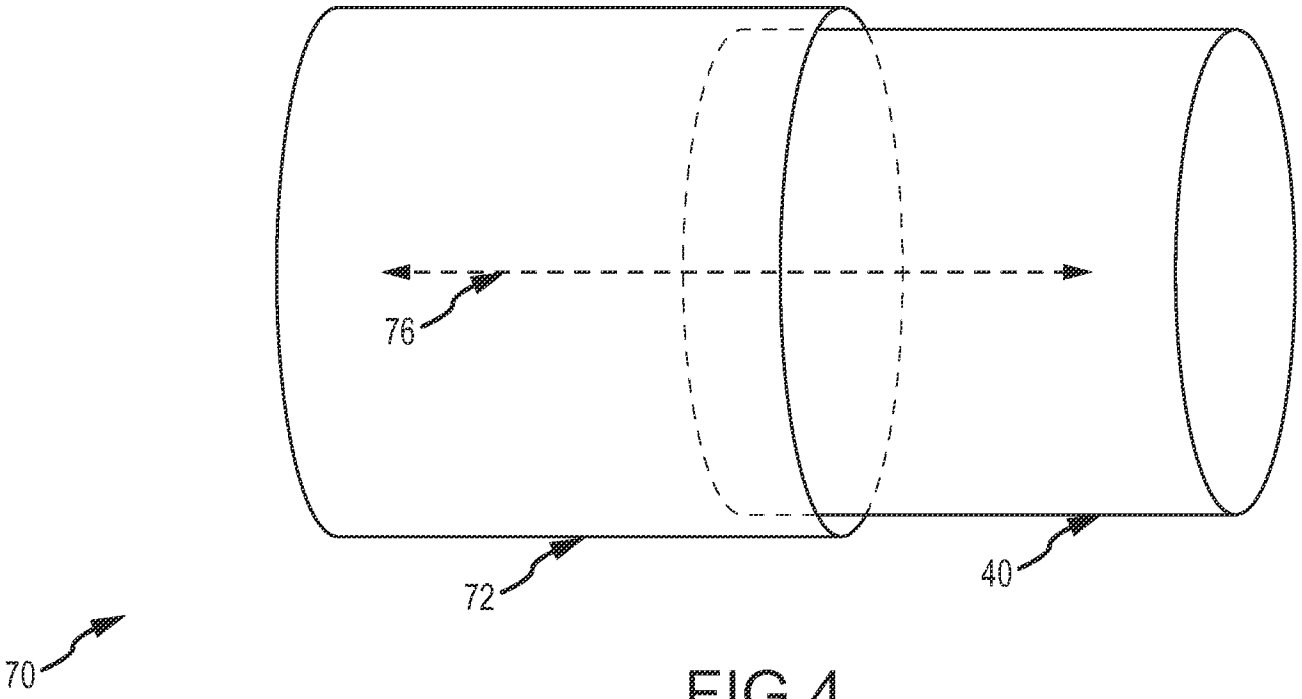
FIG. 4 is a diagram of an embodiment of a circular waveguide slip-joint.

Referring now to FIG. 4, an embodiment of a circular waveguide slip-joint 70 first and second circular waveguides 72 and 74 of different diameters allowing translation along the waveguide axis 76. The waveguide slip-joint allows the waveguide to grow or contract in length. In order to provide a constant diameter for coupling to the ball-joints on either side of the slip-joint, one of the first and second circular waveguide's diameters may transition to the diameter of the other so that the slip-joint has equal diameter circular waveguides on both sides.

Figure 5:
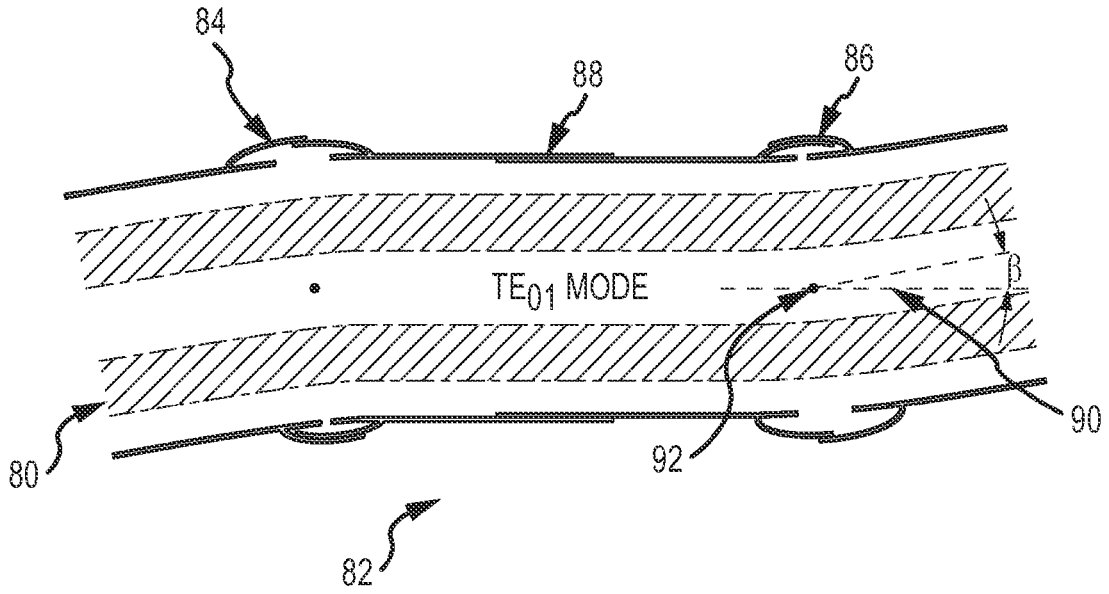
FIG. 5 is a section view of the 6-axis microwave waveguide joint transmitting microwave energy in a $TE_{01}$ mode.
Figure 6:
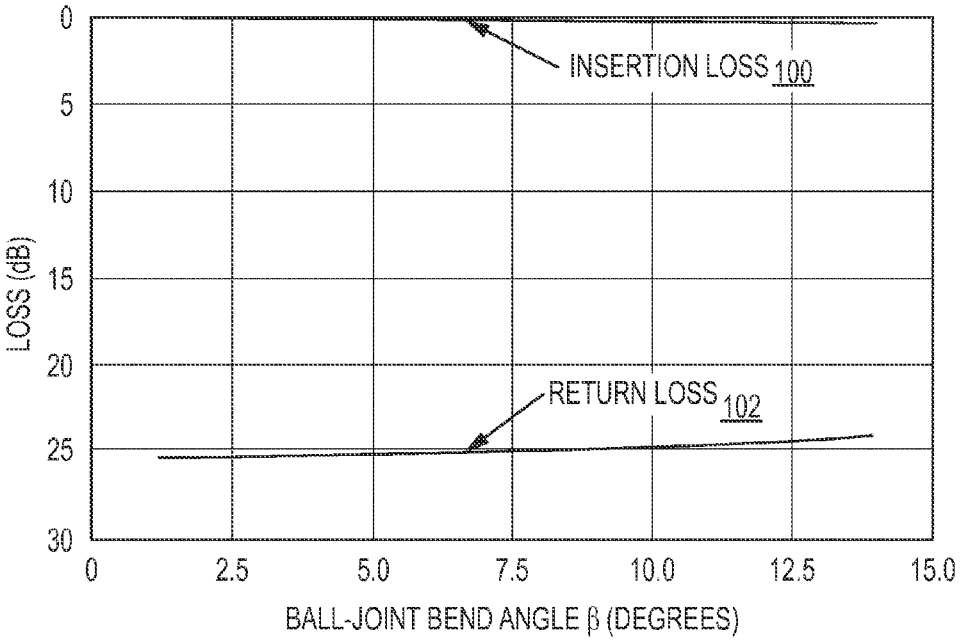
FIG. 6 is a plot of insertion and return loss as a function of ball-joint bend angle.

Referring now to FIGS. 5 and 6, a beam 80 of microwave radiation in a $TE_{01}$ mode passes through, a universal joint 82. This universal joint employs two waveguide ball-joints 84 and 86 separated by a single waveguide slip-joint 88. The waveguide ball-joint allows the circular waveguide to be both rotated (about the waveguide axis 90) and bent orthogonal to the waveguide axis (about the ball-joint rotational center 92 as shown). The circular waveguide may be bent with a bend angle β about one of the orthogonal axes and rotated with a rotation angle a about the other orthogonal axis. The waveguide slip-joint allows the waveguide to grow or contract in length. The RF loss of the universal joint has been characterized.

FIG. 6 shows the predicted insertion loss 100 and return loss 102 of a single ball-joint versus the bend angle β defined in FIG. 5. As can be seen in this figure, the RF insertion loss 100 of the ball-joint design is minimal (less than a couple tenths of a dB), even out past 10 degrees of bend angle. The performance of the ball-joint is invariant with its axial-rotation angle α since the circular $TE_{01}$ mode is axially symmetric; the ball-joint can be rotated a full 360 degrees with no change in RF performance. The slip-joint has also been shown to have an RF loss in the range of only hundredths of a dB. The power handling capabilities of this universal joint have also been analyzed and were found to exceed 20 MW (at L-band) without any pressurization. Note more power (i.e. 50 MW at L-band) can be achieved with pressurization, which will require the addition of a pressure seal in the ball- and slip-joints.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A mechanically steerable microwave transmitter, comprising:

a stationary source of a beam of microwave radiation in a first waveguide mode;

an antenna for receiving the beam of microwave radiation in a second waveguide mode and transmitting free-space radiation;

a gimbal support that supports the antenna, said gimbal support being operable to rotate the antenna about azimuth and elevation axes through the center of mass of the antenna;

a first microwave waveguide mode converter coupled to the beam source that converts the first waveguide mode of the beam to a circular axial symmetric waveguide mode;

a second microwave waveguide mode converter coupled to the antenna that converts the circular axial symmetric waveguide mode of the beam to the second waveguide mode; and a universal joint that is physically decoupled from the gimbal support, said universal joint connected between the first and second mode converters alone a waveguide axis that is offset from both the antenna's azimuth and elevation axes to route the beam of microwave radiation in the circular axial symmetric waveguide mode from the first mode converter to the second mode converter, said offset of the waveguide axis acting as a lever arm that is fixed to said antenna such that 2-axis rotation of the antenna acts through the lever arm to produce 6-axis motion, said universal joint comprising a circular waveguide slip-joint allowing for 1-dimensional translation along the waveguide axis and first and second circular waveguide ball-joints each allowing for 3-axis rotation around and orthogonal to the waveguide axis, said universal joint fixed at said first mode converter and allowing 3-axis rotation and 3-dimensional translation between the antenna and the stationary source at the connection to the second mode converter to accommodate the e six-axis motion.

2. The mechanically steerable microwave transmitter of claim 1, wherein the antenna is mass-balanced in relation to the azimuth and elevation axis without the addition of counter weights.

3. The mechanically steerable microwave transmitter of claim 1, wherein the circular waveguide slip-joint separates the first and second circular waveguide ball-joints.

4. The mechanically steerable microwave transmitter of claim 1, wherein each of said first and second hall-joints comprises a first circular waveguide fitted with a first coupler having a spherical cross section and a second circular waveguide fitted with a second coupler having a complementary spherical cross section, said first and second couplers' spherical cross sections mechanically engaged to provide 3-axis rotation around and orthogonal to the waveguide axis.

5. The mechanically steerable microwave transmitter of claim 4, wherein each of said first and second ball-joints have a defined range of motion in two axes of rotation orthogonal to the waveguide axis, said first and second circular waveguides extending into the first and second couplers to maintain a circular cross section for the microwave beam in the axial symmetric waveguide mode without interfering with the defined range of motion.

6. The mechanically steerable microwave transmitter of claim 1, wherein the circular waveguide slip-joint comprises first and second circular waveguides of different diameters allowing translation along the waveguide axis.

7. The mechanically steerable microwave transmitter of claim 1, wherein one of said first and second circular waveguides transitions to the diameter of the other so that the slip-joint has equal diameter circular waveguides.

8. The mechanically steerable microwave transmitter of claim 1, wherein at 0° rotation of the antenna about both its azimuth and elevation axes the first and second hall-joints each have 0° rotation orthogonal to the waveguide axis.

9. The mechanically steerable microwave transmitter of claim 1, wherein the universal joint allows a maximum range of motion of the antenna of +/−45° about either its azimuth or elevation axes.

10. The mechanically steerable microwave transmitter of claim 1, wherein the universal joint comprises a third circular waveguide ball-joint allowing for 3-axis rotation around and orthogonal to the wave guide axis.

11. The mechanically steerable microwave transmitter of claim 1, wherein the circular axial symmetric waveguide mode is the circular $TE_{01}$ mode.

12. The mechanically steerable microwave transmitter of claim 11, wherein the first and second waveguide modes are the rectangular $TE_{10}$ mode.

13. A microwave waveguide joint, comprising:

a first waveguide mode converter converts a first waveguide mode of a beam of microwave radiation to a circular axial symmetric waveguide mode;

a second waveguide mode converter converts the circular axial symmetric waveguide mode of the beam to a second waveguide mode; and a universal joint comprising a circular waveguide slip-joint allowing for 1-dimensional translation along a waveguide axis and first and second circular waveguide ball-joints each allowing for 3-axis rotation around and orthogonal to the waveguide axis, said universal joint connected between the first and second mode converters along the waveguide axis to route the beam of microwave radiation in the circular axial symmetric waveguide mode from the first mode converter to the second mode converter allowing 3-axis rotation and 3-dimensional translation between the first mode converter and the second mode converter.

14. The microwave waveguide joint of claim 13, wherein the circular waveguide slip-joint separates the first and second circular waveguide ball-joints.

15. The microwave waveguide joint of claim 13, wherein each of said first and second ball-joints comprises a first circular waveguide fitted with a first coupler having a spherical cross section and a second circular waveguide fitted with a second coupler having a complementary spherical cross section, said first and second couplers' spherical cross sections mechanically engaged to provide 3-axis rotation around and orthogonal to the waveguide axis over a defined range of motion, said first and second circular waveguides extending into the first and second couplers to maintain a circular cross section for the microwave beam in the axial symmetric waveguide mode without interfering with the defined range of motion.

16. The microwave waveguide joint of claim 13, wherein the circular waveguide slip-joint comprises first and second circular waveguides of different diameters allowing translation along the axis, wherein one of said first and second circular waveguides transitions to the diameter of the other so that the slip-joint has equal diameter circular waveguides.

17. The microwave waveguide joint of claim 13, wherein the universal joint comprises a third circular waveguide ball-joint.

18. The microwave waveguide joint of claim 13, wherein the circular axial symmetric waveguide mode is the circular $TE_{01}$ mode.

19. The microwave waveguide joint of claim 18, wherein the fast and second waveinlide modes are the rectangular $TE_{10}$ mode.

* * * * *